US010604981B2

(12) United States Patent
Shiroma

(10) Patent No.: US 10,604,981 B2
(45) Date of Patent: Mar. 31, 2020

(54) WINDOW REGULATOR AND CARRIER PLATE

(71) Applicant: Johnan Manufacturing Inc., Nagano (JP)

(72) Inventor: Tomotaka Shiroma, Nagano (JP)

(73) Assignee: JOHNAN MANUFACTURING INC., Nagano (JP)

( * ) Notice: Subject to any disclaimer, the term of this patent is extended or adjusted under 35 U.S.C. 154(b) by 0 days.

(21) Appl. No.: 16/225,211

(22) Filed: Dec. 19, 2018

(65) Prior Publication Data

US 2019/0194993 A1 Jun. 27, 2019

(30) Foreign Application Priority Data

Dec. 22, 2017 (JP) ..... 2017-246192

(51) Int. Cl.
*E05F 11/48* (2006.01)
*E05D 15/16* (2006.01)
*E05F 15/689* (2015.01)

(52) U.S. Cl.
CPC ..... *E05D 15/165* (2013.01); *E05F 11/486* (2013.01); *E05F 15/689* (2015.01); *E05Y 2201/492* (2013.01); *E05Y 2201/66* (2013.01); *E05Y 2900/55* (2013.01)

(58) Field of Classification Search
CPC . E05D 15/165; E05D 15/689; E05Y 2900/55; E05Y 2201/66; E05Y 2201/492; E05F 11/486
USPC ..... 49/352
See application file for complete search history.

(56) References Cited

U.S. PATENT DOCUMENTS

| | | | | |
|---|---|---|---|---|
| 5,528,861 | A * | 6/1996 | Beyerlein | E05F 11/485 49/349 |
| 9,822,568 | B2 * | 11/2017 | Matsushita | E05F 15/689 |
| 10,030,430 | B2 * | 7/2018 | Muramatsu | E05F 11/483 |
| 10,041,284 | B2 * | 8/2018 | Yamamoto | E05F 15/689 |
| 10,287,811 | B1 * | 5/2019 | Arimoto | E05D 15/165 |
| 10,329,825 | B2 * | 6/2019 | Koike | B60J 1/17 |
| 2007/0180773 | A1 * | 8/2007 | Fortin | E05F 11/485 49/352 |
| 2007/0294947 | A1 * | 12/2007 | Fassbender | E05F 11/382 49/227 |
| 2008/0005971 | A1 * | 1/2008 | Dickie | E05F 15/689 49/349 |

(Continued)

FOREIGN PATENT DOCUMENTS

JP 2016204944 A 12/2016

*Primary Examiner* — Jerry E Redman
(74) *Attorney, Agent, or Firm* — Roberts Calderon Safran & Cole P.C.

(57) ABSTRACT

A window regulator includes a guide rail provided along an ascending/descending direction of a window, a carrier plate that slides on the guide rail and moves together with the window, and an ascending-side cable for pulling the carrier plate in the ascending direction and a descending-side cable for pulling the carrier plate in the descending direction. The carrier plate includes a descending-side housing portion and a pressing portion. The descending-side housing portion houses an end of the descending-side cable and a spring provided to apply a tensile force to the descending-side cable. The pressing portion is configured to press toward the guide rail the descending-side cable extending out of the descending-side housing portion.

6 Claims, 10 Drawing Sheets

(56) References Cited

U.S. PATENT DOCUMENTS

| | | | | |
|---|---|---|---|---|
| 2008/0236049 | A1* | 10/2008 | Arimoto | E05F 11/382 49/352 |
| 2009/0007494 | A1* | 1/2009 | Pavlovic | E05F 11/382 49/349 |
| 2013/0227889 | A1* | 9/2013 | Matsushita | E05F 11/483 49/352 |
| 2017/0292312 | A1* | 10/2017 | Yokoyama | E05F 15/689 |
| 2018/0112451 | A1 | 4/2018 | Imaoka | |

* cited by examiner 3
2
20
211
212
213
3a
3b
3c
30
30f
30g
30c
301
301a
302
302a
320
320a
320b
321
310
310a
310b
B

WINDOW REGULATOR AND CARRIER PLATE

The present application is based on Japanese patent application No. 2017-246192 filed on Dec. 22, 2017, the entire contents of which are incorporated herein by reference.

BACKGROUND OF THE INVENTION

1. Field of the Invention

The invention relates to a window regulator and a carrier plate.

2. Description of the Related Art

A window regulator is known which is provided with a guide rail provided along an ascending/descending direction of a window and curved in a longitudinal direction, a carrier plate sliding on and guided by the guide rail, and an ascending-side cable and a descending-side cable that pull the carrier plate in a vertical direction (see, e.g., JP 2016/204944 A).

The carrier plate is provided with an ascending-side end holder (an ascending-side housing portion) for housing an end of the ascending-side cable and a descending-side end holder (a descending-side housing portion) for housing an end of the descending-side cable. The descending-side end holder is provided so that the descending-side cable stays on the guide rail.

JP 2016/204944 A states the window regulator can suppress abnormal noise which is caused by vibration of the descending-side cable during raising the carrier plate.

SUMMARY OF THE INVENTION

The shape of the guide rail varies depending on the type of a vehicle. If the curvature of a window is large as in a van, the curvature of the guide rail may accordingly increase such that the guide rail becomes nearly linear. In this case, the window regulator of JP 2016/204944 A may make a noise since the descending-side cable arranged on the guide rail can be relatively off the guide rail and vibrate at the time of e.g. a strong impact in closing the door.

It is an object of the invention to provide a window regulator and a carrier plate that can prevent a noise caused by a vibration of the descending-side cable even if the curvature of a guide rail increases.

According to an embodiment of the invention, a window regulator comprises:

a guide rail provided along an ascending/descending direction of a window;

a carrier plate that slides on the guide rail and moves together with the window; and an ascending-side cable for pulling the carrier plate in the ascending direction and a descending-side cable for pulling the carrier plate in the descending direction, wherein the carrier plate comprises a descending-side housing portion and a pressing portion, wherein the descending-side housing portion houses an end of the descending-side cable and a spring provided to apply a tensile force to the descending-side cable, and wherein the pressing portion is configured to press toward the guide rail the descending-side cable extending out of the descending-side housing portion.

According to another embodiment of the invention, a carrier plate used for a window regulator that is used to raise and lower a window, the carrier plate comprising:

a descending-side housing portion that houses an end of the descending-side cable pulling the carrier plate in a descending direction and a spring provided to apply a tensile force to the descending-side cable; and a pressing portion that presses toward the guide rail the descending-side cable extending out of the descending-side housing portion, wherein the pressing portion of the carrier plate comprises an outlet path allowing the descending-side cable to extend out from the descending-side housing portion to the outside of the carrier plate, and wherein the outlet path is inclined so as to get closer to the guide rail from the bottom surface of the descending-side housing portion toward the carrier plate.

Effects of the Invention

According to an embodiment of the invention, a window regulator and a carrier plate can be provided that can prevent a noise caused by a vibration of the descending-side cable even if the curvature of a guide rail increases.

BRIEF DESCRIPTION OF THE DRAWINGS

Next, the present invention will be explained in more detail in conjunction with appended drawings, wherein.

DETAILED DESCRIPTION OF THE PREFERRED EMBODIMENTS

Summary of Embodiments

Figure 1:
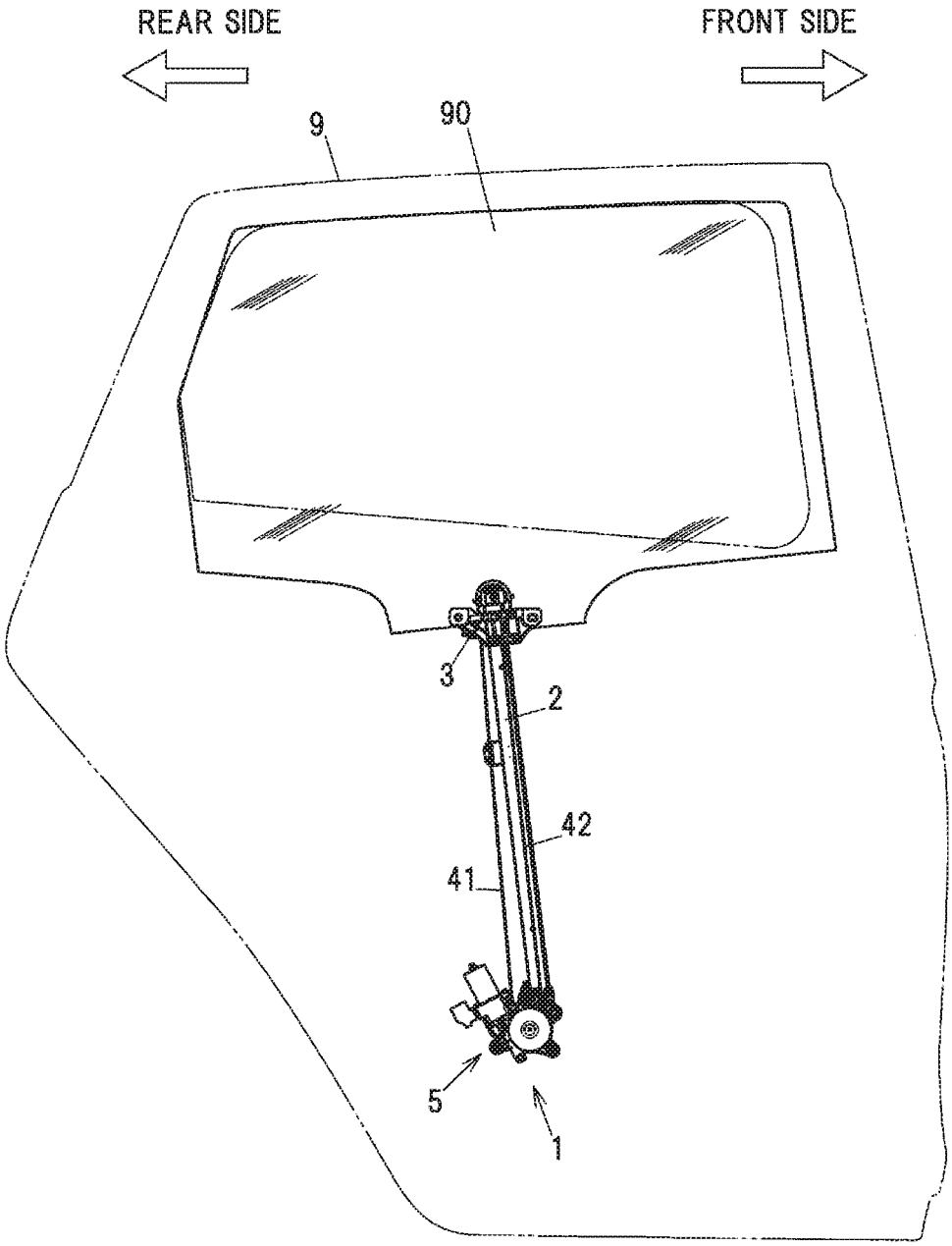
FIG. 1 is a general schematic diagram illustrating a window regulator in the first embodiment of the present invention and a vehicle door mounting the window regulator.

A window regulator 1 in the embodiments is provided with a guide rail 2 provided along an ascending/descending direction of a window 90, a carrier plate 3 that slides on the guide rail 2 and moves together with the window 90, an ascending-side cable 41 for pulling the carrier plate 3 in the ascending direction and a descending-side cable 42 for pulling the carrier plate 3 in the descending direction, wherein the carrier plate 3 comprises a descending-side housing portion 320 and a pressing portion, the descending-side housing portion 320 houses an end of the descending-side cable 42 and a descending-side coil spring 72 provided to apply a tensile force to the descending-side cable 42, and the pressing portion presses toward the guide rail 2 the descending-side cable 42 extending out of the descending-side housing portion 320.

The window regulator 1 can prevent abnormal noise due to vibration of the descending-side cable 42 even when a curvature of the guide rail 2 is large.

First Embodiment

The window regulator in the first embodiment of the invention is a device for raising and lowering a window on, e.g., an automobile door and is installed on a door panel of an automobile.

General Configuration of the Window Regulator 1

Figure 2:
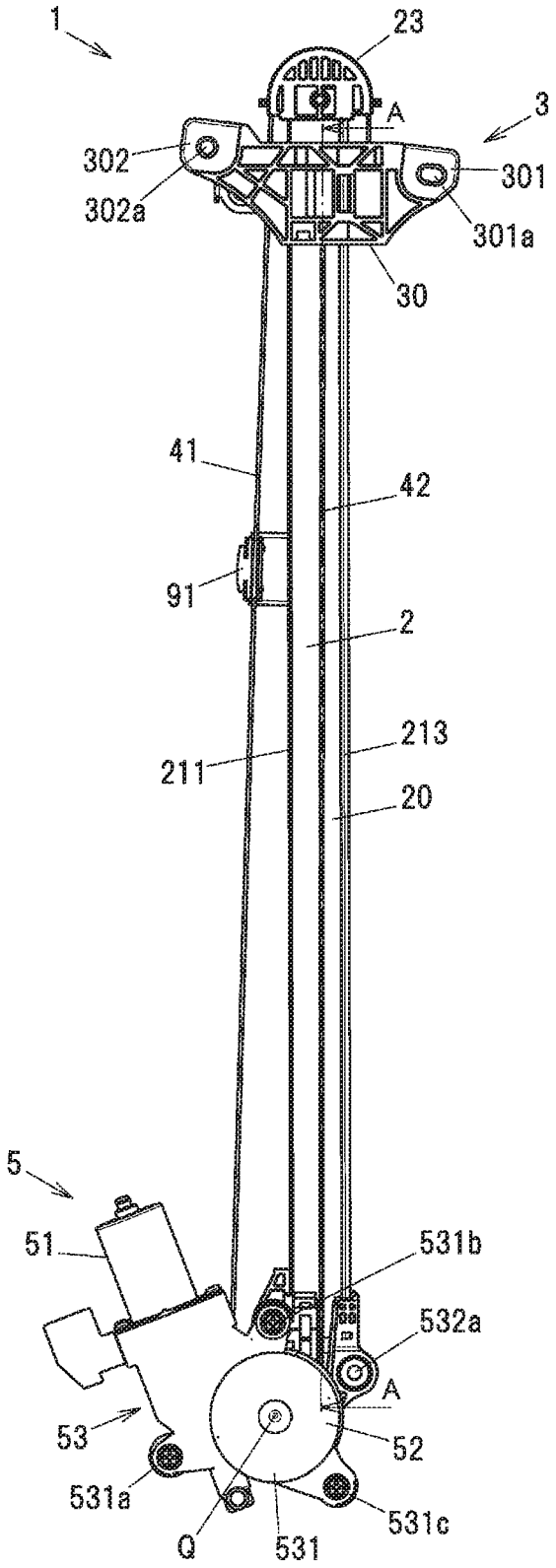
FIG. 2 is an overall view showing a configuration of the window regulator.

FIG. 1 is a general schematic diagram illustrating the window regulator 1 in the present embodiment and a door 9 of a vehicle mounting the window regulator 1. FIG. 2 is an overall view showing a configuration of the window regulator 1. In FIG. 1, the window 90 is in a fully-closed state, and the door 9 and a window frame are indicated by dash-dot-dot lines. In addition, in FIG. 1, the left side of the paper is the rear side in the vehicle longitudinal direction and the right side of the paper is the front side in the vehicle longitudinal direction. FIG. 2 is an overall view showing a configuration of the window regulator 1.

As shown in FIGS. 1 and 2, the window regulator 1 is generally composed of the guide rail 2 which is housed in a door panel (not shown) provided on the door 9 of the vehicle and is arranged along an ascending/descending direction of the window 90, the carrier plate 3 which slides on the guide rail 2 and moves together with the window 90, the ascending-side cable 41 and the descending-side cable 42 which pull the carrier plate 3, and a drive unit 5 which generates a driving force for taking up and feeding out the ascending-side cable 41 and the descending-side cable 42.

Configuration of the Guide Rail 2

The guide rail 2 is formed by bending a long metal plate at a predetermined curvature and is arranged so as to tilt to the rear side in the vehicle longitudinal direction with respect to the door 9. The guide rail 2 integrally has a flat plate portion 20 extending in a longitudinal direction thereof, first and second side plate portions 211 and 212 provided upright from both edges of the flat plate portion 20 which are the edges in a width direction orthogonal to the longitudinal direction thereof, and a flange portion 213 projecting from an end of the second side plate portion 212 toward the side opposite to the flat plate portion 20. Of the first and second side plate portions 211 and 212, the first side plate portion 211 is a side plate portion arranged on the rear side in the vehicle longitudinal direction. In FIG. 2, the first and second side plate portions 211 and 212 protrude toward the near side (reader's side) of the paper.

Configuration of the Carrier Plate 3

The carrier plate 3 is a plate-shaped member formed of, e.g., a resin such as polyacetal. The carrier plate 3 integrally has a main body 30 sliding on the guide rail 2, and first and second supports 301 and 302 respectively provided on both ends of the main body 30 to support the window 90. Attachment holes 301*a* and 302*a*, which are provided to attach a support member (not shown) for supporting the window 90, are respectively provided on the first and second supports 301 and 302.

Configuration of the Ascending-Side Cable 41 and the Descending-Side Cable 42

The ascending-side cable 41 is coupled to the carrier plate 3 at one end, turns at a cable guide 23 provided at the top end of the flat plate portion 20, and is coupled to a drum 52 of the drive unit 5 (described later) at the other end. The descending-side cable 42 is coupled to the carrier plate 3 at one end and is coupled to the drum 52 at the other end.

The ascending-side cable 41 is routed so as not to overlap the guide rail 2 between the cable guide 23 and the drum 52 when viewed in a direction along a rotational axis Q of the drum 52. The descending-side cable 42 is routed so as to overlap the guide rail 2 between the carrier plate 3 and the drum 52 when viewed in a direction along the rotational axis Q of the drum 52.

The ascending-side cable 41 is supported by a cable support member 91 which is provided near the longitudinal center portion of the guide rail 2.

Configuration of the Drive Unit 5

The drive unit 5 has a motor 51 with reducer, the cylindrical drum 52 (indicated by a dashed line in FIG. 2) which is rotationally driven by the motor 51 and rotates to take up and feed out the ascending-side cable 41 and the descending-side cable 42, and a housing 53 which is provided at a lower end of the guide rail 2 to hold the motor 51 and house the drum 52. The housing 53 is composed of a drum housing 532 having a drum housing portion for housing the drum 52, and a motor housing 531 fitted to the lower end of the guide rail 2 and holding the motor 51. The drum housing 532 and the motor housing 531 are fastened to each other by first to third fixing portions 531*a* to 531*c* (see FIG. 6 which is described later).

Details of the Carrier Plate 3

Next, the carrier plate 3 and the periphery thereof will be described in reference to FIGS. 3 to 5.

Figures 3A, 3B, 3C, 3D, 3E:
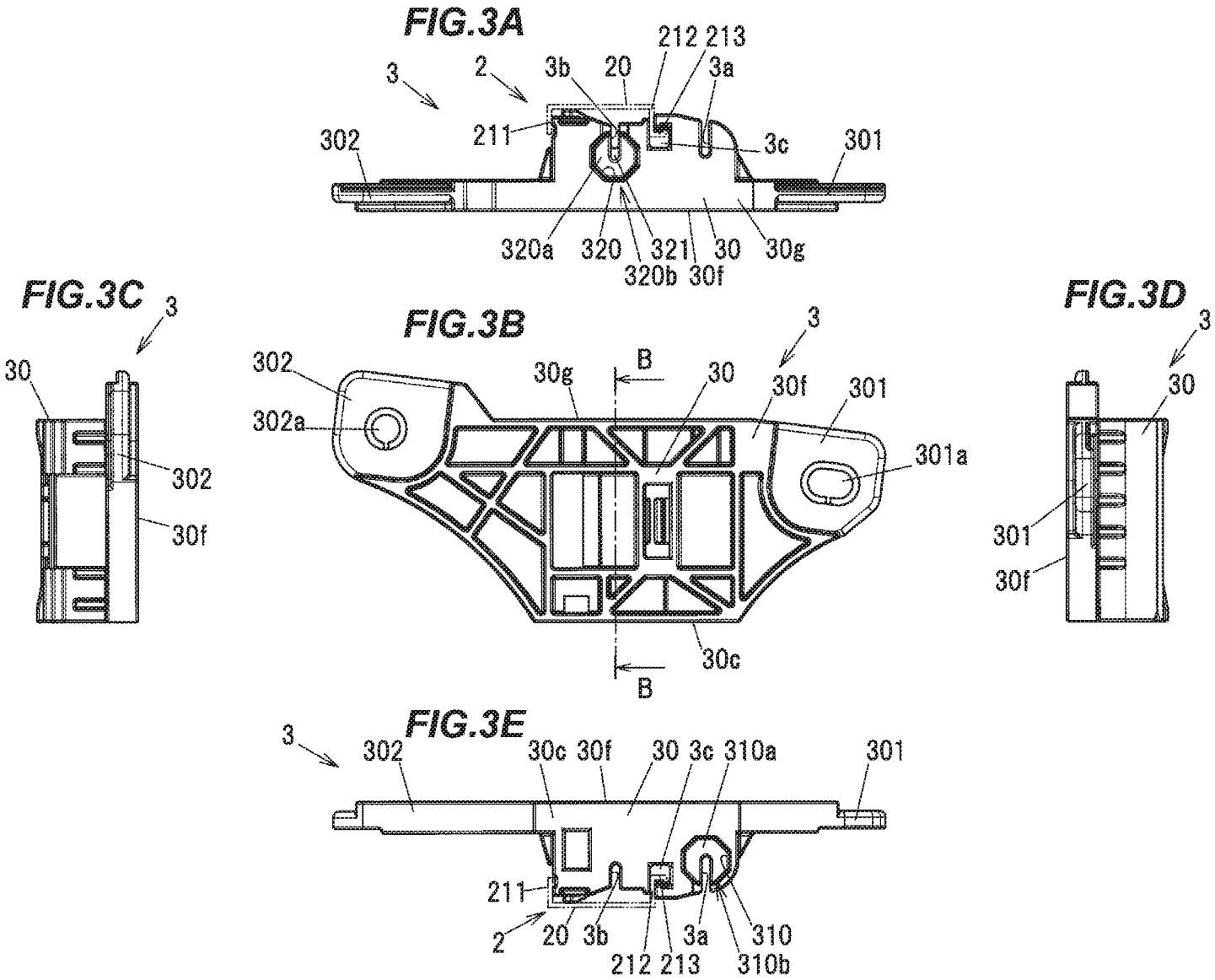
FIGS. 3A to 3E are plan views showing a configuration example of a carrier plate.

FIGS. 3A to 3E are plan views showing a configuration example of the carrier plate 3, wherein FIG. 3A is a top view, FIG. 3B is a front view, FIG. 3C is a left side view, FIG. 3D is a right side view, and FIG. 3E is a bottom view. FIG. 4 shows a configuration of the back side of the carrier plate 3 and is a plan view showing ascending-side and descending-side coil springs 71, 72 and ascending-side and descending-side cable ends 410, 420 together with the carrier plate 3. FIG. 5 is a cross sectional view taken along line B-B in FIG. 3B. In FIGS. 3A and 3E, the guide rail 2 is indicated by a dash-dot-dot line. In FIG. 4, an ascending-side housing portion 310 and a descending-side housing portion 320 (described later) are indicated by dashed lines.

The carrier plate 3 is provided with the ascending-side housing portion 310 and the descending-side housing portion 320. The ascending-side housing portion 310 houses the ascending-side cable end 410 provided at one end of the ascending-side cable 41 and the ascending-side coil spring 71 applying a tensile force to the ascending-side cable 41. The descending-side housing portion 320 houses the descending-side cable end 420 provided at one end of the descending-side cable 42 and the descending-side coil spring 72 applying a tensile force to the descending-side cable 42.

As shown in FIG. 3A, the descending-side housing portion 320 has a bottomed cylindrical shape and has an opening 320*b* on an upper surface 30*g* at which the carrier plate 3 faces the cable guide 23 at the top dead centre of the carrier plate 3.

A bottom surface 320*a* of the descending-side housing portion 320 can be seen from the outside of the carrier plate 3 through the opening 320*b*. The opening 320*b* also serves as an insertion hole through which the descending-side cable end 420, a descending-side slide bush 62 and the descending-side coil spring 72 are inserted into the descending-side housing portion 320. The top dead centre of the carrier plate 3 here is the uppermost point on the guide rail 2 within the travel range in which the carrier plate 3 can move on the guide rail 2.

As shown in FIG. 3E, the ascending-side housing portion 310 has a bottomed cylindrical shape and has an opening 310*b* on a bottom surface 30*c* at which the carrier plate 3 faces the housing 53 at the bottom dead centre of the carrier plate 3.

A bottom surface 310*a* of the ascending-side housing portion 310 can be seen from the outside of the carrier plate 3 through the opening 310*b*. The opening 310*b* also serves as an insertion hole through which the ascending-side cable end 410, an ascending-side slide bush 61 and the ascending-side coil spring 71 are inserted into the ascending-side housing portion 310. The bottom dead centre of the carrier plate 3 here is the lowermost point on the guide rail 2 within the travel range in which the carrier plate 3 can move on the guide rail 2.

As shown in FIG. 3B, plural ribs are provided on a front surface 30*f* of the carrier plate 3 which is a surface located on the side opposite to the surface facing the guide rail 2. Rigidity of the carrier plate 3 is thereby improved.

As shown in FIGS. 3A and 3E, an ascending-side slit 3*a*, a descending-side slit 3*b* and a fitting groove 3*c* are formed on the main body 30 of the carrier plate 3. The ascending-side slit 3*a* and the descending-side slit 3*b* serve as housing entrances used when placing the ascending-side cable 41 and the descending-side cable 42 in the ascending-side housing portion 310 and the descending-side housing portion 320. The fitting groove 3*c* receives the flange portion 213 of the guide rail 2 which is fitted thereto. The ascending-side housing portion 310 and the descending-side housing portion 320 have a substantially regular octagonal shape when viewed in a direction along the central axis thereof. However, the shape of the ascending-side housing portion 310 and the descending-side housing portion 320 is not limited thereto and may be, e.g., a circular shape or a regular hexagonal shape.

The ascending-side slit 3*a* extends across the carrier plate 3 from the upper surface 30*g* to the bottom surface 30*c*. The ascending-side slit 3*a* also opens on the side opposite to the front surface 30*f* of the carrier plate 3 and is connected to a housing space of the ascending-side housing portion 310.

Likewise, the descending-side slit 3*b* extends across the carrier plate 3 from the upper surface 30*g* to the bottom surface 30*c*. The descending-side slit 3*b* also opens on the side opposite to the front surface 30*f* of the carrier plate 3 and is connected to a housing space of the descending-side housing portion 320.

Figure 4:
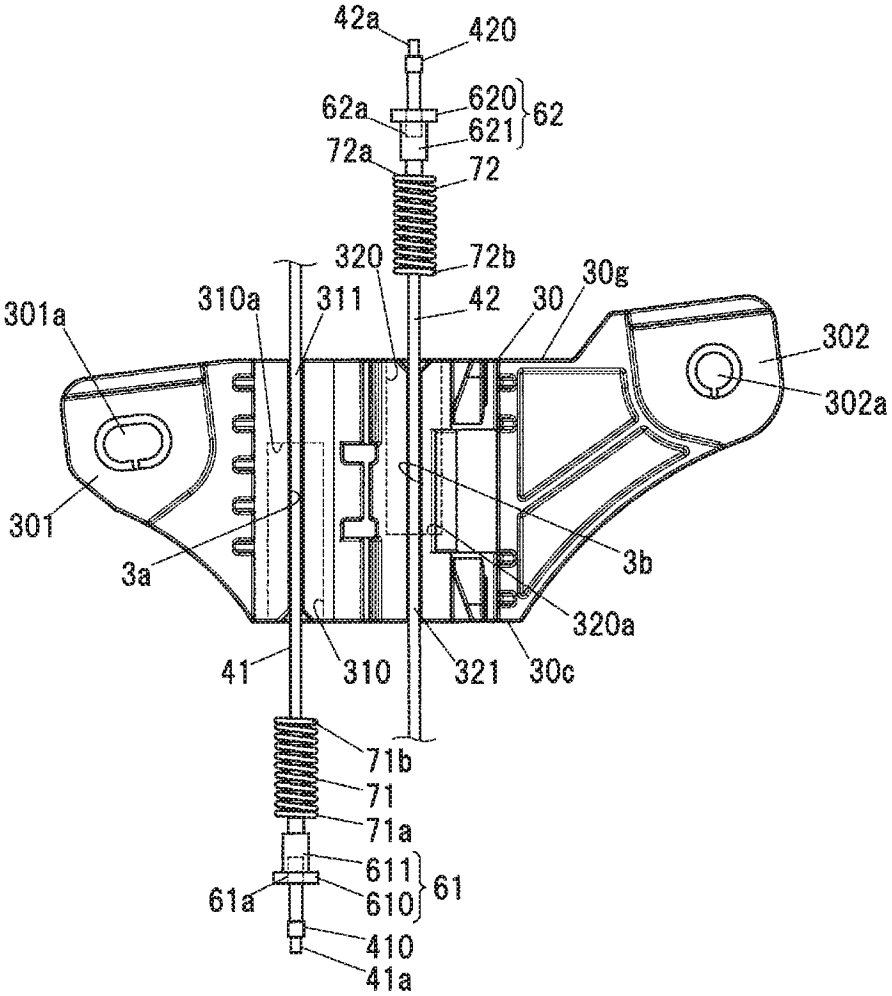
FIG. 4 is a plan view showing the configuration of the carrier plate, together with springs and ends of cables.

As shown in FIG. 4, the carrier plate 3 is provided with an ascending-side outlet path 311 allowing the ascending-side cable 41 to extend out from the ascending-side housing portion 310 to the outside of the carrier plate 3 and a descending-side outlet path 321 allowing the descending-side cable 42 to extend out from the descending-side housing portion 320 to the outside of the carrier plate 3.

The ascending-side outlet path 311 penetrates the bottom surface 310*a* of the ascending-side housing portion 310 along the central axis of the ascending-side housing portion 310, and also faces the flat plate portion 20 of the guide rail 2 with the ascending-side slit 3*a* interposed therebetween. The ascending-side outlet path 311 further extends from the bottom surface 310*a* of the ascending-side housing portion 310 to the upper surface 30*g* of the carrier plate 3 in a direction along the central axis of the ascending-side housing portion 310.

The descending-side outlet path 321 penetrates the bottom surface 320*a* of the descending-side housing portion 320 along the central axis C (shown in FIG. 5) of the descending-side housing portion 320, and also can be seen from the outside of the carrier plate 3 through the descending-side slit 3*b*. The descending-side outlet path 321 further extends from the bottom surface 320*a* of the descending-side housing portion 320 to the bottom surface 30*c* of the carrier plate 3 in a direction along the central axis C of the descending-side housing portion 320.

Meanwhile, as shown in FIG. 4, the substantially rectangular parallelepiped-shaped ascending-side cable end 410 formed of a metal such as zinc, the cylindrical ascending-side slide bush 61 engaging the ascending-side cable end 410, and the ascending-side coil spring 71 allowing the ascending-side cable 41 to be inserted therethrough and applying a tensile force are provided on the ascending-side cable 41 at an end coupled to the carrier plate 3. The ascending-side cable end 410 is attached on the end 41*a* side of the ascending-side cable by a fixing means, e.g., crimping, etc.

Likewise, the substantially rectangular parallelepiped-shaped descending-side cable end 420 formed of a metal such as zinc, the cylindrical descending-side slide bush 62 engaging the descending-side cable end 420, and the descending-side coil spring 72 allowing the descending-side cable 42 to be inserted therethrough and applying a tensile force are provided on the descending-side cable 42 at an end coupled to the carrier plate 3. The descending-side cable end 420 is attached on the end 42*a* side of the descending-side cable by a fixing means, e.g., crimping, etc.

The ascending-side slide bush 61 has a flange portion 610 and a cylinder portion 611 having a smaller diameter than the flange portion 610. A bottomed cylindrical-shaped locking hole 61*a* with a bottom surface serving as a locking surface engaging the ascending-side cable end 410 is provided inside the cylinder portion 611. The cylinder portion 611 is inserted into the ascending-side coil spring 71 and the flange portion 610 comes into contact with an end 71*a* of the ascending-side coil spring 71. The ascending-side cable end 410, the ascending-side slide bush 61 and the ascending-side coil spring 71 are housed in the ascending-side housing portion 310.

The ascending-side coil spring 71 is arranged such that the end 71*a* is in contact with the flange portion 610 of the ascending-side slide bush 61 as described above and the other end 71*b* is in contact with the bottom surface 310*a* of the ascending-side housing portion 310 in which the ascending-side coil spring 71 is housed in a compressed state. Thus, a tensile force is applied to the ascending-side cable 41 which is thereby prevented from slacking.

Likewise, the descending-side slide bush 62 has a flange portion 620 and a cylinder portion 621 having a smaller diameter than the flange portion 620. A bottomed cylindrical-shaped locking hole 62*a* with a bottom surface serving as a locking surface engaging the descending-side cable end 420 is provided inside the cylinder portion 621. The cylinder portion 621 is inserted into the descending-side coil spring 72 and the flange portion 620 comes into contact with an end 72*a* of the descending-side coil spring 72. The descending-side cable end 420, the descending-side slide bush 62 and the descending-side coil spring 72 are housed in the descending-side housing portion 320.

The descending-side coil spring 72 is arranged such that the end 72*a* is in contact with the flange portion 620 of the descending-side slide bush 62 as described above and the other end 72*b* is in contact with the bottom surface 320*a* of the descending-side housing portion 320 in which the descending-side coil spring 72 is housed in a compressed state. Thus, a tensile force is applied to the descending-side cable 42 which is thereby prevented from slacking.

Figure 5:
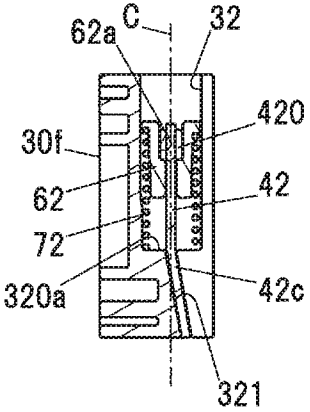
FIG. 5 is a cross sectional view taken along line B-B in FIG. 3B.

As shown in FIG. 5, the descending-side outlet path 321 is inclined so as to get closer to the flat plate portion 20 of the guide rail 2 from the bottom surface 320*a* of the descending-side housing portion 320 toward the outside of the carrier plate 3. Thus, the descending-side cable 42 in the descending-side outlet path 321 is pressed toward the flat plate portion 20 of the guide rail 2 (see FIG. 7 which is described later). That is, the descending-side outlet path 321 of the carrier plate 3 serves as a pressing portion which presses toward the guide rail 2 the descending-side cable 42 extending out of the descending-side housing portion 320.

Functions and Effects of the Embodiment

Figure 6:
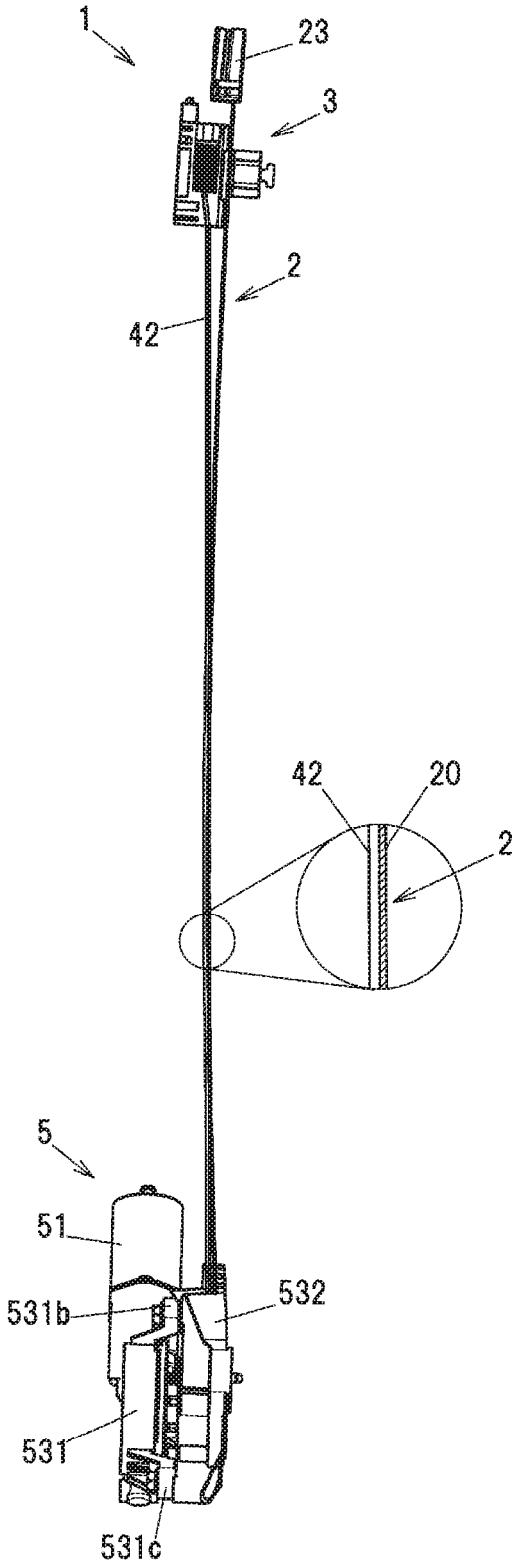
FIG. 6 is a cross sectional view taken along line A-A in FIG. 2.
Figure 7:
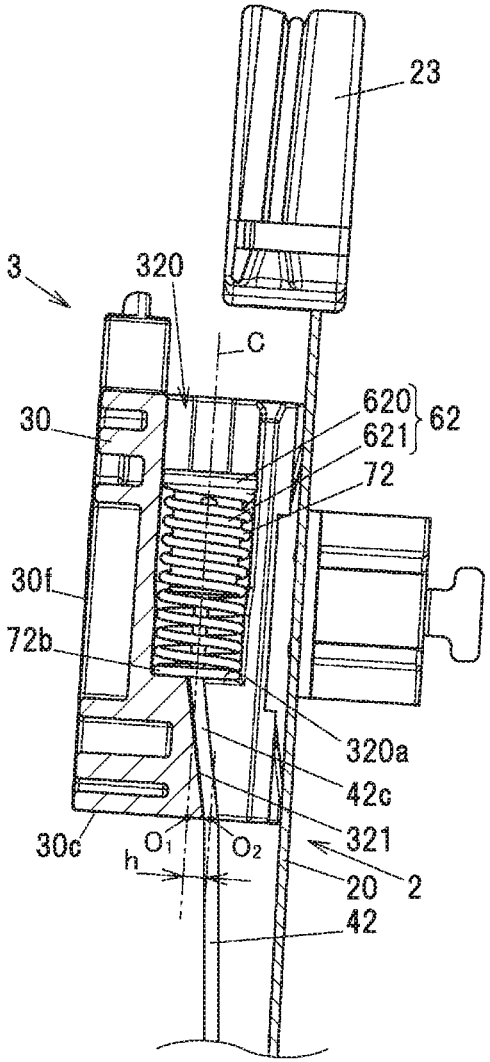
FIG. 7 is an enlarged view showing a portion of the window regulator shown in FIG. 6.

Next, the functions and effects obtained by the embodiment of the invention will be described in reference to FIGS. 6 and 7. FIG. 6 is a cross sectional view showing the window regulator 1 taken along line A-A in FIG. 2. FIG. 7 is an enlarged view showing the carrier plate 3 and its periphery in the window regulator 1 shown in FIG. 6. FIGS. 6 and 7 show the state in which the carrier plate 3 is located at the top dead centre.

As shown in FIG. 7, an outlet position $O_2$ is offset by a predetermined distance h from a reference point $O_1$ in a thickness direction of the carrier plate 3 (a direction orthogonal to the flat plate portion 20 of the guide rail 2 on which the carrier plate 3 slides), where the reference point $O_1$ is a point of intersection of the central axis C of the descending-side housing portion 320 and the bottom surface 30*c* of the carrier plate 3 and the outlet position $O_2$ is a point from which the descending-side cable 42 extends out of the carrier plate 3. The predetermined distance h here is a value which allows contact between the flat plate portion 20 of the guide rail 2 and the descending-side cable 42 at a longitudinal position of the guide rail 2 where the descending-side cable 42 comes closest to the flat plate portion 20 of the guide rail 2 when the carrier plate 3 is located at the top dead centre. For example, when the guide rail has a longitudinal length L of 556 mm and a curvature R of 5200 mm, the distance h is not less than 2.8 mm.

Since the descending-side cable 42 is pressed toward the guide rail 2 by the descending-side outlet path 321 as described above, the outlet position of the descending-side cable 42 extending out of the descending-side housing portion 320 is offset to the guide rail 2 side relative to the center axis C of the descending-side housing portion 320 as a reference line.

In more details, the descending-side cable 42 has an inclined portion 42*c* located in the descending-side outlet path 321 and inclined with respect to a direction in which the descending-side cable 42 arranged in the descending-side housing portion 320 extends. The descending-side housing portion 320 may alternatively be formed to be inclined so that the center axis C of the descending-side housing portion 320 extends along the inclined portion 42*c* of the descending-side cable 42.

Such configuration allows the descending-side cable 42 to come into contact with the flat plate portion 20 of the guide rail 2 at a position where the descending-side cable 42 comes closest to the flat plate portion 20 of the guide rail 2 between the carrier plate 3 and the housing 53 when the carrier plate 3 is located at the top dead centre, as shown in FIG. 6. In other words, the descending-side cable 42 is in contact with the flat plate portion 20 of the guide rail 2 in a state that the descending-side cable 42 routed on the guide rail 2 is the maximum length. As a result, even when, e.g., a strong impact generated by closing the door is transferred to the descending-side cable 42, abnormal noise due to vibration of the descending-side cable 42 is reliably prevented since the descending-side cable 42 is in contact with the flat plate portion 20 of the guide rail 2.

Comparative Example

Figure 8:
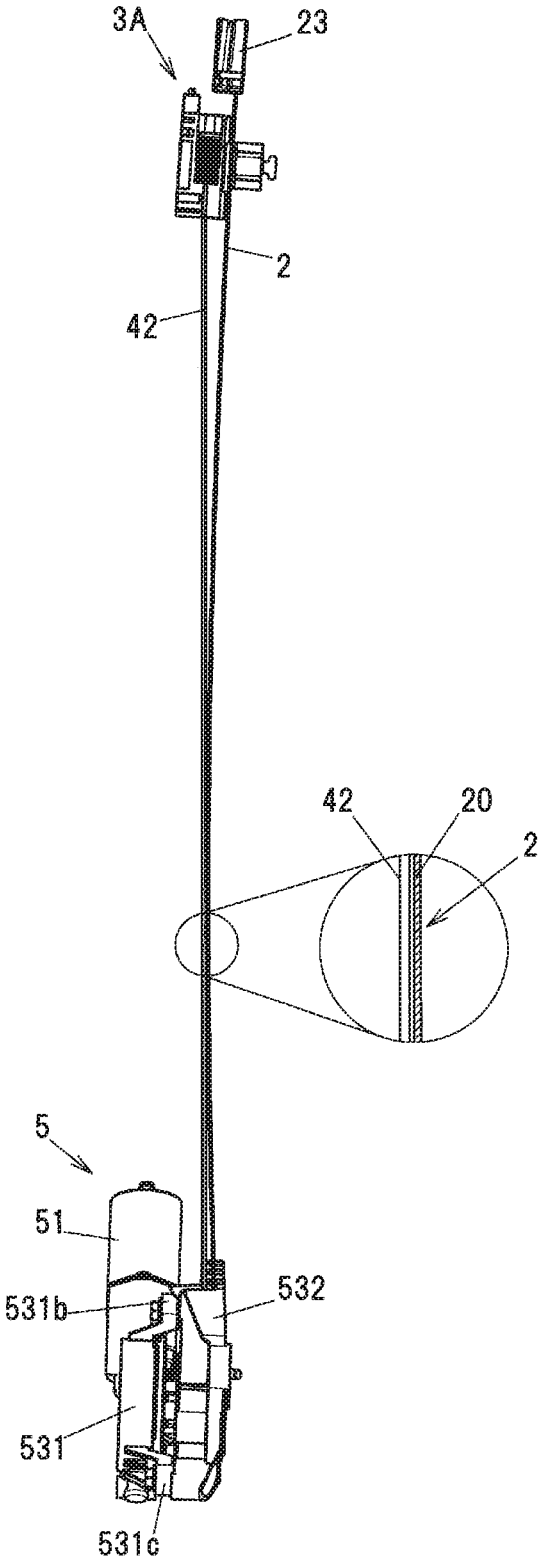
FIG. 8 is an explanatory diagram illustrating a configuration of a window regulator in Comparative Example.
Figure 9:
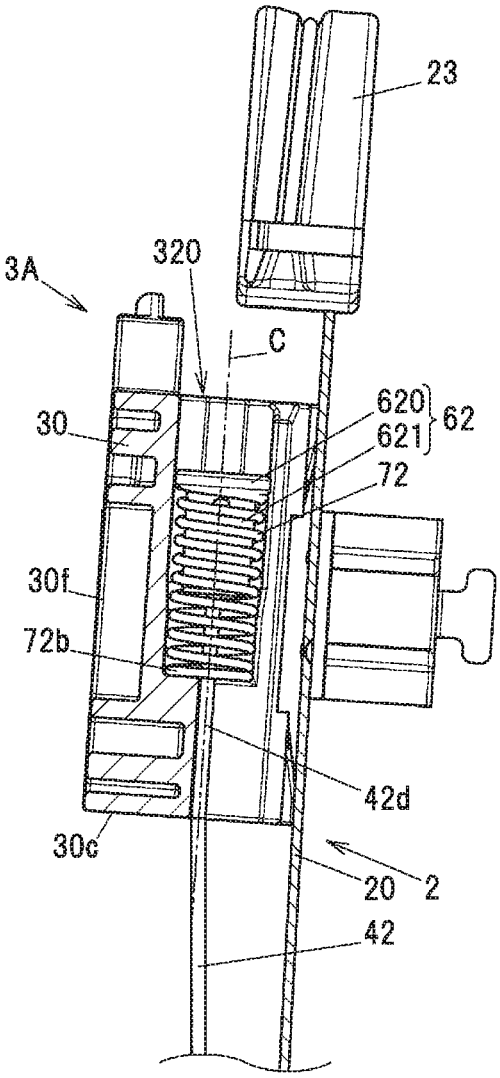
FIG. 9 is an enlarged view showing a portion of the window regulator in Comparative Example shown in FIG. 8.

Next, a window regulator in Comparative Example will be described in reference to FIGS. 8 and 9. FIG. 8 is an explanatory diagram illustrating a configuration of a window regulator in Comparative Example. FIG. 9 is an enlarged view showing a portion of the window regulator in Comparative Example shown in FIG. 8.

The window regulator in Comparative Example is configured in the same manner as the window regulator 1 in the first embodiment, except the configuration of the carrier plate 3. In FIGS. 8 and 9, constituent elements having substantially the same functions as those described in the first embodiment are denoted by the same reference numerals and the overlapping explanation thereof will be omitted.

A carrier plate 3A in Comparative Example is configured that the descending-side outlet path 321 thereof is not inclined. In other words, the descending-side outlet path 321 of the carrier plate 3A in Comparative Example extends parallel to a direction along the central axis C of the descending-side housing portion 320, as shown in FIG. 9. Therefore, the outlet position of the descending-side cable 42 extending out of the descending-side housing portion 320 is not offset to the guide rail 2 side relative to the center axis C of the descending-side housing portion 320 as a reference line.

In this configuration, the descending-side cable 42 is not pressed toward the flat plate portion 20 of the guide rail 2. Therefore, a gap is formed between the descending-side cable 42 and the flat plate portion 20 of the guide rail 2 at a position where the descending-side cable 42 comes closest to the flat plate portion 20 of the guide rail 2 when the carrier plate 3 is located at the top dead centre, as shown in FIG. 8. In this case, the descending-side cable 42 when vibrating may hit the flat plate portion 20 of the guide rail 2 and generate abnormal noise.

In contrast, since the carrier plate 3 in the first embodiment is provided with the outlet path 321 which presses the descending-side cable 42 toward the guide rail 2, the outlet position of the descending-side cable 42 extending out of the carrier plate 3 is offset toward the guide rail 2. This configuration allows the descending-side cable 42 to reliably come into contact with the flat plate portion 20 of the guide rail 2 even when the guide rail 2 is formed linear with a large curvature. In other words, abnormal noise caused by vibration of the descending-side cable 42 is reliably prevented.

Second Embodiment

Next, the window regulator 1 in the second embodiment will be described in reference to FIGS. 10A and 10B. FIGS.

Figure 10A:
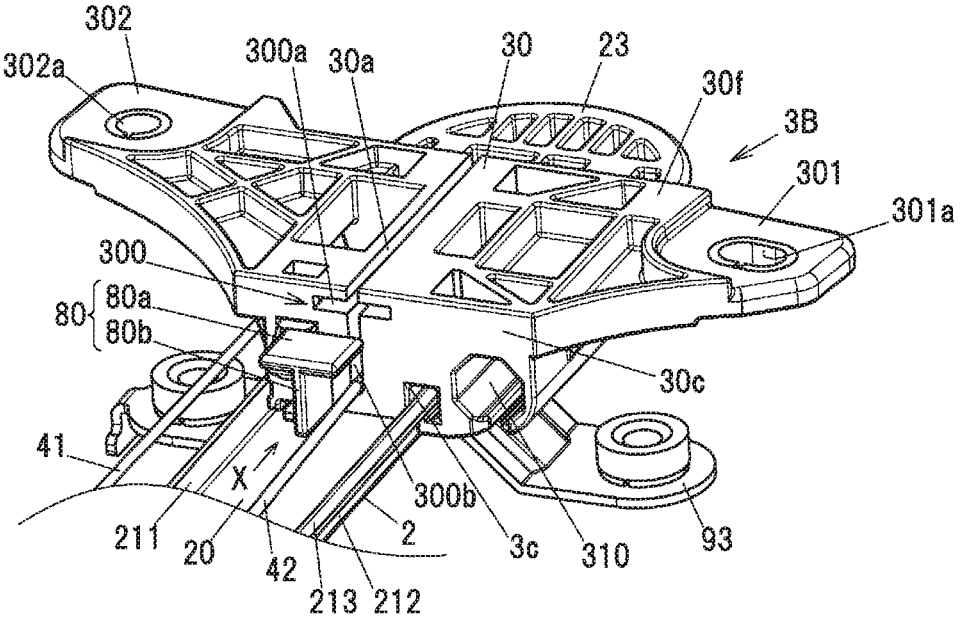
FIGS. 10A and 10B are explanatory diagrams illustrating a carrier plate and a portion of a guide rail of a window regulator in the second embodiment of the invention.
Figure 10B:
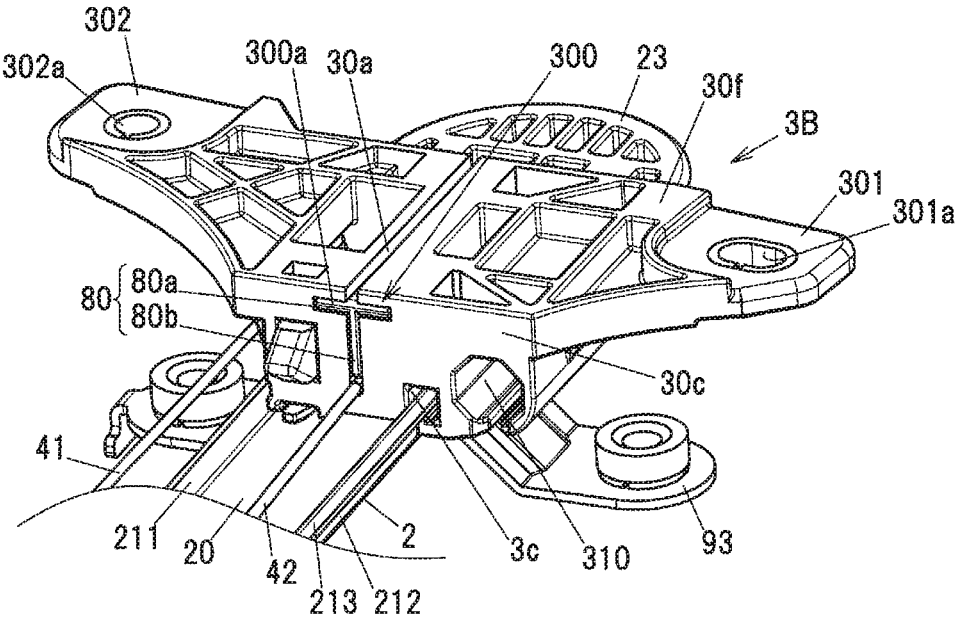

10A and 10B are explanatory diagrams illustrating a carrier plate and a portion of a guide rail of a window regulator in the second embodiment of the invention, wherein FIG. 10A shows the state before attaching a pressing member 80 (described alter) and FIG. 10B shows the state after attaching the pressing member 80.

The window regulator 1 in the second embodiment is configured in the same manner as the window regulator 1 in the first embodiment, except the configuration of the carrier plate 3. In FIGS. 10A and 10B, constituent elements having substantially the same functions as those described in the first embodiment are denoted by the same reference numerals and the overlapping explanation thereof will be omitted.

A pressing means for pressing the descending-side cable 42 toward the guide rail 2 is different in a carrier plate 3B of the second embodiment. That is, in the second embodiment, the descending-side cable 42 is pressed toward the guide rail 2 by the pressing member 80 which is arranged to be integrated with the carrier plate 3B.

The carrier plate 3B has a slit 30*a* formed as a housing entrance which opens on the front surface 30*f* located on the side opposite to the surface facing the flat plate portion 20 of the guide rail 2 and is used when placing the descending-side cable 42 in the descending-side housing portion 320. The slit 30*a* is connected to the housing space of the descending-side housing portion 320 and extends along a travel direction of the carrier plate 3B such that the carrier plate 3B is vertically halved.

The pressing member 80 is a member formed of, e.g., a resin such as POM and has a substantially T-shape. The pressing member 80 integrally has a horizontally-extended portion 80*a* and a vertically-extended pressing portion 80*b* which extends downward from the center portion of the horizontally-extended portion 80*a*.

The carrier plate 3B has a fitting hole 300 to which the pressing member 80 is fitted. The fitting hole 300 opens on the bottom surface 30*c* of the carrier plate 3B and is composed of a horizontally-extended hole 300*a* for fitting the horizontally-extended portion 80*a* of the pressing member 80 and a vertically-extended hole 300*b* for fitting the pressing portion 80*b* of the pressing member 80. The descending-side cable 42 extending out from the bottom surface 320*a* of the descending-side housing portion 320 is arranged in the vertically-extended hole 300*b* of the fitting hole 300.

When the pressing member 80 is attached to the main body 30 of the carrier plate 3B, the pressing member 80 is brought close to the bottom surface 30*c* of the carrier plate 3B in a direction along the extending direction of the descending-side cable 42 (a direction of an arrow X) while pressing the descending-side cable 42 toward the guide rail 2 by an end portion of the pressing portion 80*b*, and is then fitted to the fitting hole 300 of the carrier plate 3B. In this state, the descending-side cable 42 is pressed toward the flat plate portion 20 of the guide rail 2 by the pressing portion 80*b* of the pressing member 80.

That is, the pressing portion 80*b* of the pressing member 80, which is a pressing portion of the carrier plate 3B, is fitted to the fitting hole 300 connected to the slit 30*a* and is integrated with the carrier plate 3B. The pressing portion 80*b* of the pressing member 80 is an example of "a part of a pressing member" of the invention.

In the second embodiment, since the descending-side cable 42 is pressed toward the guide rail 2 by the pressing member 80, the outlet position of the descending-side cable 42 extending out of the carrier plate 3B is offset toward the guide rail 2. This configuration allows the descending-side cable 42 to reliably come into contact with the flat plate portion 20 of the guide rail 2 even when the guide rail 2 is formed linear with a large curvature. In other words, abnormal noise caused by vibration of the descending-side cable 42 is reliably prevented.

Third Embodiment

Figure 11A:
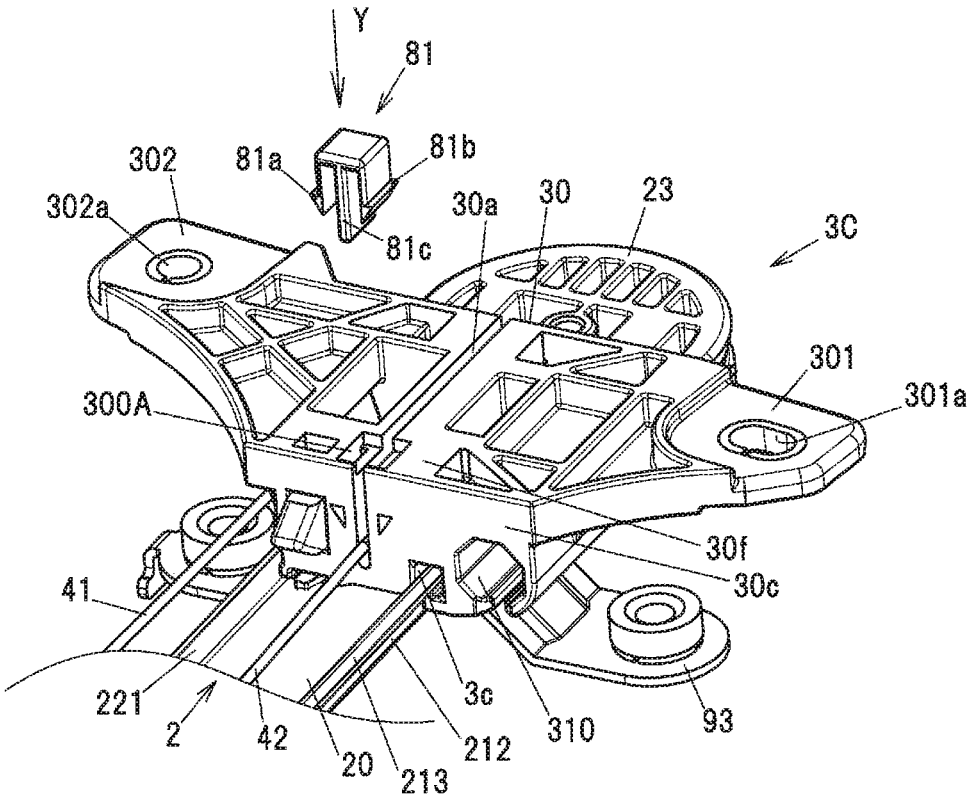
FIGS. 11A and 11B are explanatory diagrams illustrating a carrier plate and a portion of a guide rail of a window regulator in the third embodiment of the invention.
Figure 11B:
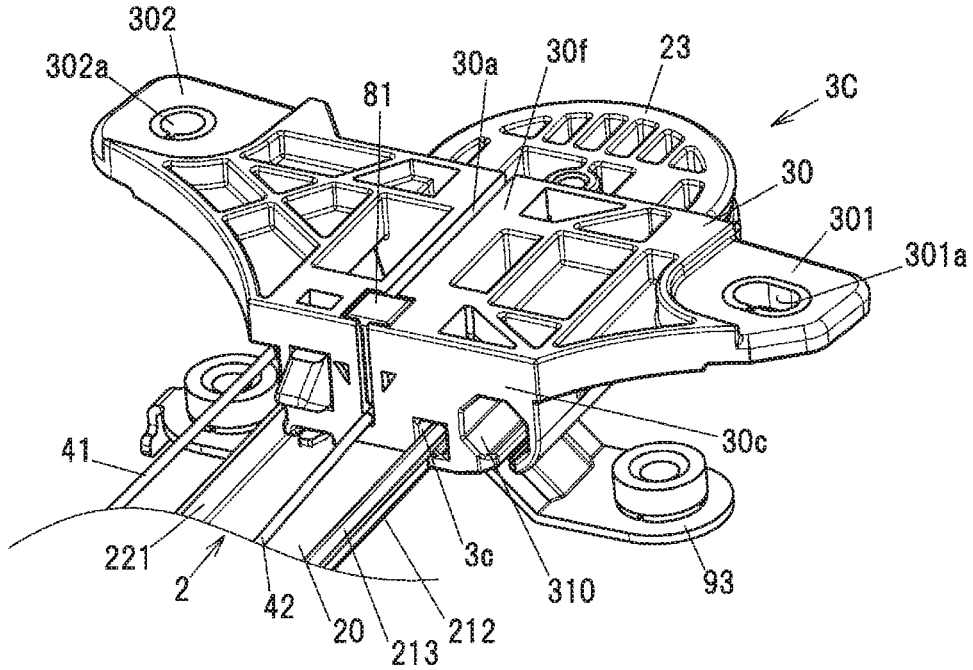

Next, the window regulator 1 in the third embodiment will be described in reference to FIGS. 11A and 11B. FIGS. 11A and 11B are explanatory diagrams illustrating a carrier plate and a portion of a guide rail of a window regulator in the third embodiment of the invention, wherein FIG. 11A shows the state before attaching a pressing member 81 (described alter) and FIG. 11B shows the state after attaching the pressing member 81.

The window regulator 1 in the third embodiment is configured in the same manner as the window regulator 1 in the second embodiment, except the configurations of the carrier plate 3B and the pressing member 80. In FIGS. 11A and 11B, constituent elements having substantially the same functions as those described in the second embodiment are denoted by the same reference numerals and the overlapping explanation thereof will be omitted.

A carrier plate 3C in the third embodiment is different from the carrier plate 3B in the second embodiment in the position of the fitting hole for fitting the pressing member 81. That is, a fitting hole 300A of the carrier plate 3C is provided on the front surface 30*f* as an end face located on the side opposite to a surface at which the carrier plate 3C faces the guide rail 2. The fitting hole 300A is a substantially rectangular hole which opens on the front surface 30*f* of the carrier plate 3C. The fitting hole 300A is connected to the slit 30*a* and is located on the lower end side where the descending-side cable 42 extends out of the carrier plate 3C.

The pressing member 81 is a member formed of, e.g., a resin such as POM and integrally has a pair of locking claws 81*a*, 81*b* engaging the fitting hole 300A and a pressing portion 81*c* which presses the descending-side cable 42. The pair of locking claws 81*a*, 81*b* prevent the pressing member 81 from slipping out of the fitting hole 300A.

When the pressing member 81 is attached to the main body 30 of the carrier plate 3C, the pressing member 81 is brought close to the fitting hole 300A from the front surface 30*f* side of the carrier plate 3C and is then fitted to the fitting hole 300A while pressing the descending-side cable 42 toward the guide rail 2 by the pressing portion 81*c*. In this state, the descending-side cable 42 is pressed toward the flat plate portion 20 of the guide rail 2.

That is, the pressing portion 81*c* of the pressing member 81, which is a pressing portion of the carrier plate 3C, is fitted to the fitting hole 300A connected to the slit 30*a* and is integrated with the carrier plate 3C. The pressing portion 81*c* of the pressing member 81 is an example of "a part of a pressing member" of the invention.

In the third embodiment, since the descending-side cable 42 is pressed toward the guide rail 2 by the pressing member 81, the outlet position of the descending-side cable 42 extending out of the carrier plate 3C is offset toward the guide rail 2. This configuration allows the descending-side cable 42 to reliably come into contact with the flat plate portion 20 of the guide rail 2 even when the guide rail 2 is formed linear with a large curvature. In other words, abnormal noise caused by vibration of the descending-side cable 42 is reliably prevented.

Although the embodiments the invention have been described, the invention according to claims is not to be limited to the embodiments. Further, please note that all combinations of the features described in the embodiments are not necessary to solve the problem of the invention. The invention can be appropriately modified and implemented without departing from the gist thereof.

What is claimed is:

1. A window regulator, comprising:

a guide rail provided along an ascending and descending direction of a window;

a carrier plate that slides on the guide rail and moves together with the window; and an ascending-side cable for pulling the carrier plate in the ascending direction and a descending-side cable for pulling the carrier plate in the descending direction, wherein the carrier plate comprises a descending-side housing portion and a pressing portion, wherein the descending-side housing portion houses an end of the descending-side cable and a spring provided to apply a tensile force to the descending-side cable, and wherein the pressing portion is configured to press the descending-side cable extending out of the descending-side housing portion toward the guide rail.

2. The window regulator according to claim 1, wherein the pressing portion of the carrier plate comprises an outlet path allowing the descending-side cable to extend out from the descending-side housing portion to an outside of the carrier plate, and wherein the outlet path is inclined so as to get closer to the guide rail from the bottom surface of the descending-side housing portion toward the carrier plate.

3. The window regulator according to claim 1, wherein the pressing portion of the carrier plate constitutes a part of a pressing member that is fitted to a fitting hole formed continuous to a housing space of the descending-side housing portion and is arranged to be integrated with the carrier plate.

4. The window regulator according to claim 3, wherein the fitting hole is provided on the bottom surface of the carrier plate from which the ascending-side cable extends out.

5. The window regulator according to claim 3, wherein the fitting hole is provided on an end face of the carrier plate on an opposite side to a surface facing the guide rail.

6. A carrier plate used for a window regulator that is used to raise and lower a window, the carrier plate comprising:

a descending-side housing portion that houses an end of the descending-side cable pulling the carrier plate in a descending direction and a spring provided to apply a tensile force to the descending-side cable; and a pressing portion that presses toward the guide rail the descending-side cable extending out of the descending-side housing portion, wherein the pressing portion of the carrier plate comprises an outlet path allowing the descending-side cable to extend out from the descending-side housing portion to an outside of the carrier plate, and wherein the outlet path is inclined so as to get closer to the guide rail from a bottom surface of the descending-side housing portion toward the carrier plate.

* * * * *